US006440047B1

(12) United States Patent
Huang

(10) Patent No.: US 6,440,047 B1
(45) Date of Patent: Aug. 27, 2002

(54) EXERCISING DEVICE FOR SIMULATING HULA-HOOP ROTATIONS

(76) Inventor: Hsiao-Ping Huang, 2F, No. 29, Lane 66, Juei-Kuang Road, Nei-Hu District, Taipei (TW)

( * ) Notice: Subject to any disclaimer, the term of this patent is extended or adjusted under 35 U.S.C. 154(b) by 0 days.

(21) Appl. No.: 09/835,646

(22) Filed: Apr. 12, 2001

(51) Int. Cl.[7] ..... A63B 71/00
(52) U.S. Cl. ..... 482/148; 482/110; 446/236
(58) Field of Search ..... 482/23–24, 45–48, 482/131, 136, 110, 148; 446/77, 266, 236

(56) References Cited

U.S. PATENT DOCUMENTS 3,109,651 A * 11/1963 Wheeler ..... 273/109
3,186,124 A * 6/1965 Voss ..... 46/51
3,509,660 A * 5/1970 Seymour ..... 1/32
4,221,074 A * 9/1980 Gonzalez ..... 446/28
4,846,459 A * 7/1989 Vivian ..... 482/74
6,036,573 A * 3/2000 Huang ..... 446/242
6,217,482 B1 * 4/2001 Yoo et al. ..... 482/10
D442,094 S * 5/2001 Seo ..... D10/65
6,231,420 B1 * 5/2001 Lin ..... 446/236
6,319,086 B1 * 11/2001 Shen ..... 446/236

* cited by examiner

*Primary Examiner*—Michael A. Brown
*Assistant Examiner*—Lori Baker Amerson

(57) ABSTRACT

An exercising device for simulating hula-hoop rotations includes: a housing having at least a track annularly formed in the housing, at least a ball rolling or rotably moving in the track upon a hula-hoop rotation by a user who wears the housing of the exercising device, and an audio and visual device provided on the housing to indicate or display the whirling movements audiovisually.

7 Claims, 4 Drawing Sheets

EXERCISING DEVICE FOR SIMULATING HULA-HOOP ROTATIONS

BACKGROUND OF THE INVENTION

U.S. Pat. No. 6,036,573 to H. T. Huang disclosed an exercising hula hoop which is turned around a user's body. However, such a prior art has the following drawbacks:

1. The hula hoops is rotated each full turn around the user's body so that the diameter of the hula hoop should be large enough to allow the user's body to be positioned in the hoop. So, the hoop will be carried or stored inconveniently.
2. The visual display (15) is located on the hoop, whereby upon a continuous rotation during exercising the hoop, the data shown on the display (15) will be impossibly or difficultly observed.
3. The micro-switch (17) is mounted on the hoop at an inner side of the hoop body in order to be triggered by the user's body. The inner side of the hoop to provide the micro-switch (17) therein will form a convex portion protruding centripetally from the hoop ring to influence an ergonomic or comfortable exercise whenever the user's waist or body portion is contacting the protruding micro-switch (17).

The present inventor has found the drawbacks of the conventional hula hoop and invented an exercising device for simulating the hula-hoop rotations.

SUMMARY OF THE INVENTION

The object of the present invention is to provide an exercising device for simulating hula-hoop rotations including: a housing having at least a track annularly formed in the housing, at least a ball rolling or rotably moving in the track upon a hula-hoop rotation by a user who wears the housing of the exercising device, and an audio and visual device provided on the housing to indicate or display the whirling movements audiovisually.

DETAILED DESCRIPTION

Figure 1:
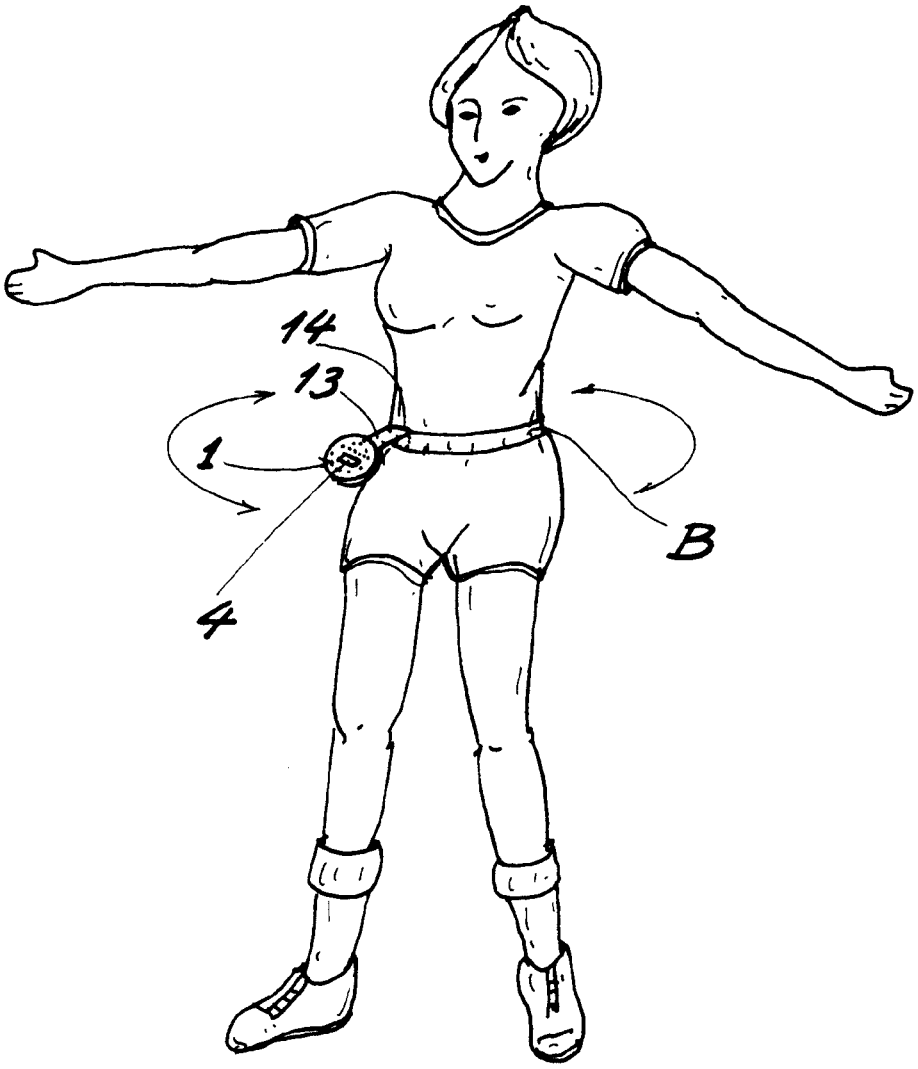
FIG. 1 is an illustration showing the application of the present invention when worn by a user.

As shown in FIGS. 1~5, the exercising device of the present invention comprises: a housing 1, at least a ball 2 rolling or rotatably moving in the housing 1, a locking means 3 for locking or unlocking the ball 2 within the housing 1, and an audio and visual means 4 provided in or on the housing 1 for indicating or displaying the whirling movements of the exercising device audiovisually.

The housing 1 is generally circular shape and includes: a plurality of tracks 11, 11*a* . . . concentrically formed on a bottom of the housing 1 each track provided for the rolling movement of the ball 2 therein; a top cover 12 covering the top portion of the housing 1; a handle portion 13 formed on a side portion of the housing 1 for holding or carrying purpose; and a fastening portion 14 formed on a free end portion or rear end portion of the handle portion 13 adapted to be fastened on a belt B of the user or clipped on a user's waist or body portion.

The fastening portion 14 may be integrally formed with a fastening strip or belt tied on the user's or wearer's waist or body portion.

The number of balls 2 or tracks 11, 11*a* and the shapes, designs of the elements of the present invention are not limited.

The ball 2 is preferably made of steel or any other materials. If the locking means 3 includes magnetic elements, the ball 2 should thus be made of steel or ferrous materials to be magnetically attracted by the locking means 3, which will be described hereinafter.

Figure 2:
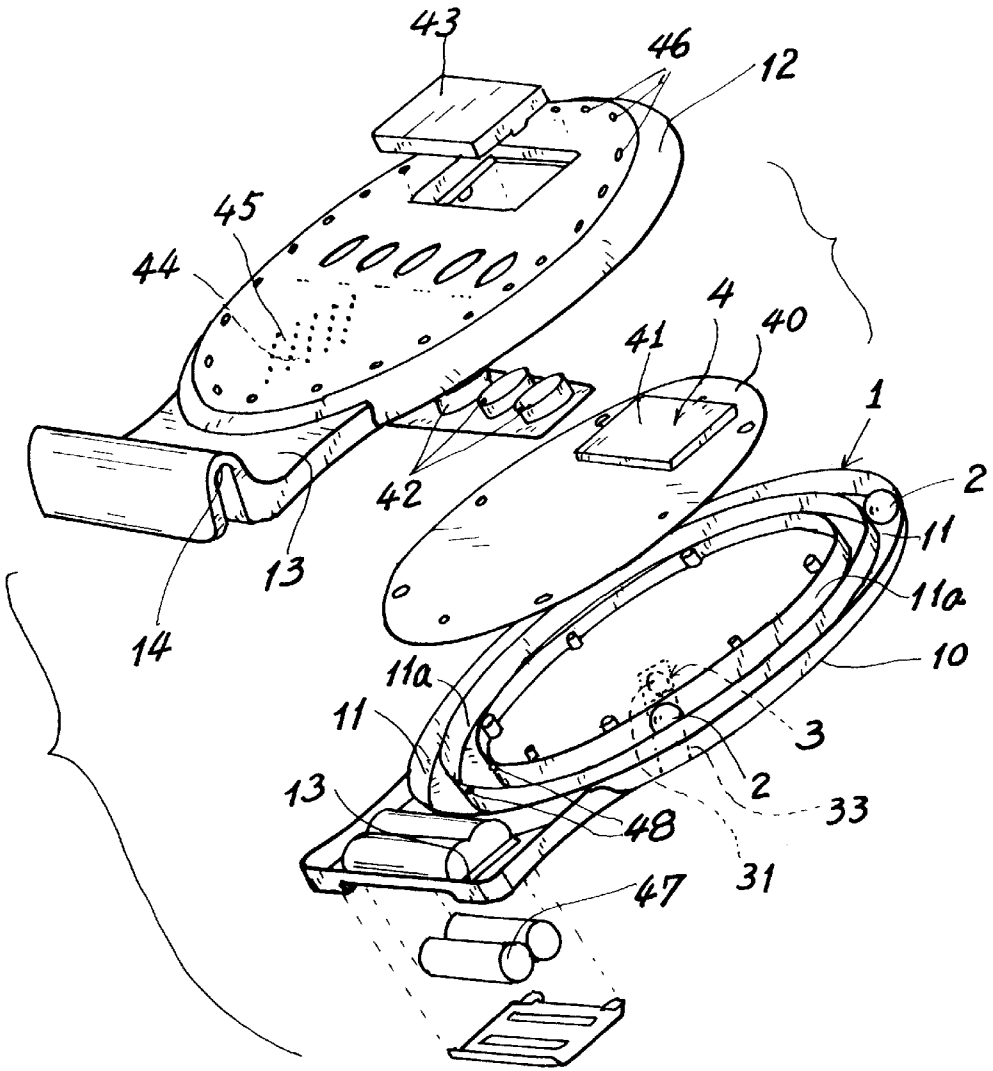
FIG. 2 is an exploded view showing the elements of the present invention.
Figure 3:
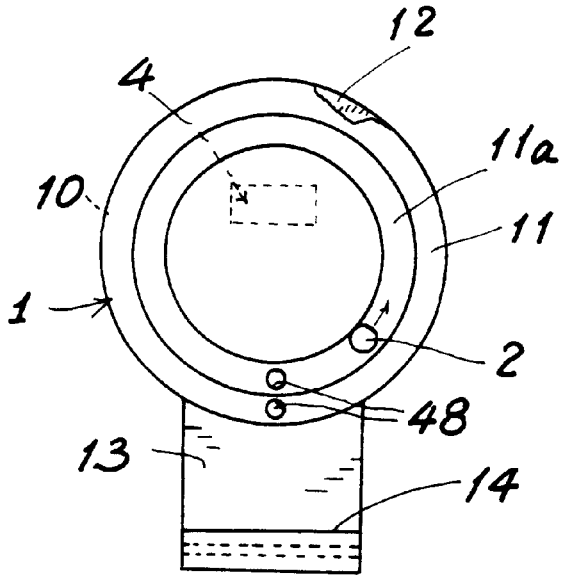
FIG. 3 is a top view illustration of the present invention.
Figure 4:
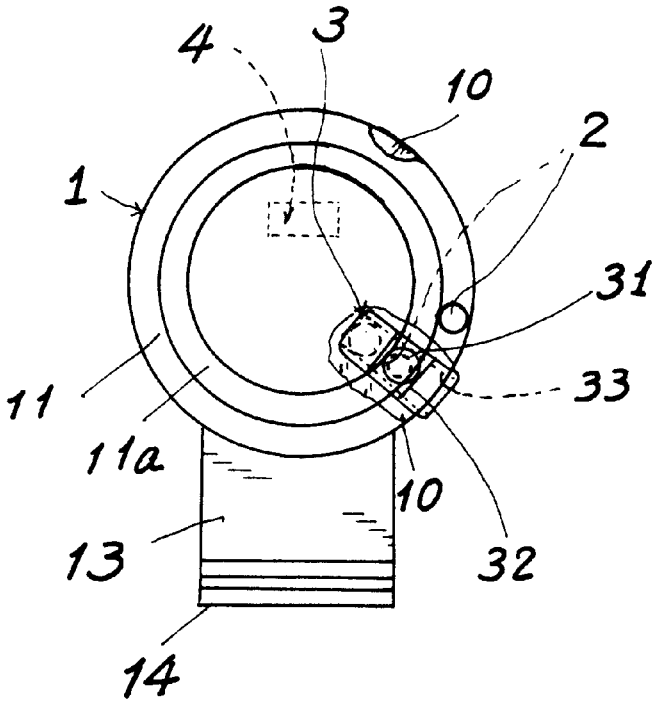
FIG. 4 is a bottom view illustration of the present invention.
Figure 5:
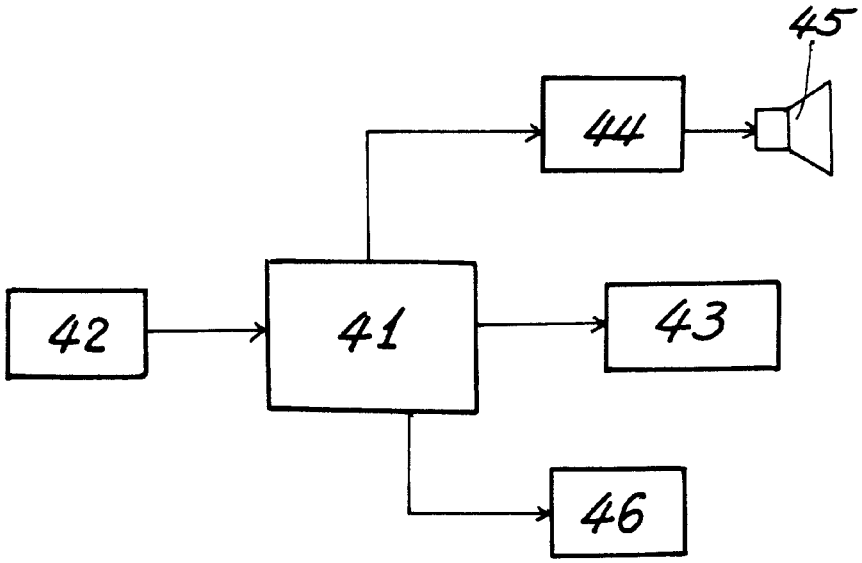
FIG. 5 shows a block diagram of the audio and visual means of the present invention.

The locking means 3 especially as shown in FIGS. 2, 4 includes: at least a magnet 31 capable of magnetically attracting said ball made of ferrous materials and mounted or formed on a slide 32 slidably engageable on a pair of rails 33 formed in the housing 1 transversely overpassing across the tracks 11, 11*a*; and a stand-by position 30 formed on a central (or inner) portion of the housing 1 for initially resting the ball 2 thereon without being magnetically attracted by the magnet 31; whereby upon sliding movement of the magnet 31 on the slide 32 along the rails 33 to approximate the ball 2 in the track 11 or 11*a* in order to magnetically attract the ball 2 to stop its rolling movement in the track; and upon returning of the magnet 31 to the stand-by position 30 to release the magnetic attraction between the magnet 31 and the ball 2, the ball 2 will be rolled in the track 11 upon a whirling movement by the user or wearer of the present invention for exercise.

The audio and visual means 4 includes: a microprocessor 41 mounted on a board 40 secured in the housing 1; a plurality of selecting switches 42 formed in the housing 1 for selecting a plurality of operational modes to be input into the microprocessor 41 for processing and outputting audio and visual signals; a liquid crystal display (LCD) 43 formed on the top cover 12 of the housing 1 for visually showing output data as processed by the microprocessor 41 corresponding to the rolling of the ball 2 in the housing; an audio transducer 44 connected to the microprocessor 41 for transducing audio signal output from the microprocessor 41 to be audio sound or synthetic voice through a speaker 45 connected to the transducer 44 corresponding to the rolling of ball 2 in the housing; and an optical indicator 46 including a plurality of flashing light-emitting diodes (LED) annularly disposed on the top cover 12 of the housing 12 for outputting optical flashing corresponding to the rolling of the ball 2 in the housing 1; and at least a sensor 48 provided in each track 11 for sensing the ball 2 when passing through the sensor to complete each turn when rolling in the track.

The selecting switches 42 includes: an on-off switch for switching on or off the power as supplied from a power source, for instance, a battery 47 stored in the housing 1; a MUTE switch for switching off the output of sound or voice as output from the microprocessor 41 and the transducer 44; a MEMORU switch for memory of the number of turns when whirling the housing 1 for rotating the ball 2 for comparison purpose for each exercise; a calorie consumption switch for calculating the calorie as consumed during whirling movement of the user for rotating the ball 2 and whirling housing 1 in order to control body weight of the user; and a track selector switch for selecting the specific track 11, 11*a* . . . for rolling the ball or balls 2 therein each track 11 (11*a*) provided with a sensor 48 for sensing the ball 2 when passing through the sensor 48 when completing each rolling turn in the track.

Upon whirling of the user's body (waist and hip) for whirling the housing 1 and rolling the ball 2 in the housing 1 of the present invention, the rolling speed of the ball 2 will be sensed by the sensor 48 and a plurality of output signals will be indicated or shown, for example, the rotation speed of ball (the turns per time period of the ball corresponding to the whirling speed of the housing and the user wearing the housing) as shown on the LCD 43; the speed as reported through the speaker 45; or the speed as optically flashing on the LEDs 46 (quicker whirling having a quicker flashing of LEDs, while slower whirling having slower flashing of LEDs).

Figure 6:
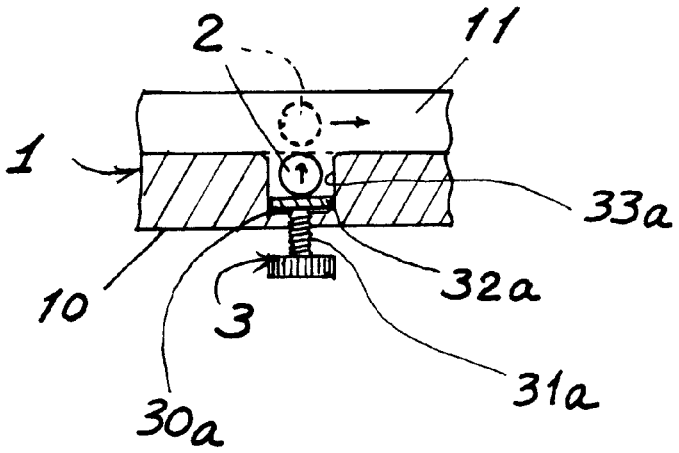
FIG. 6 is a partial sectional drawing of a locking means for locking or unlocking the ball of the present invention.

As shown in FIG. 6, the locking means 3 may be modified to include: a screw 31*a* rotatably mounted in the housing 1, a disk portion 32*a* formed on an inner end of the screw 31*a* to hold the ball 2 to be downwardly rested in a bottom 30*a* of a well 33*a* recessed in the track 11 (or 11*a*); whereby upon rising of the screw and the disk portion 32*a* along the well 33*a* until reaching a bottom level of the track 11 (11*a*), the ball 2 (as dotted line shown on FIG. 6) will be initiated for rolling along the track upon whirling of the user and the housing worn on the user.

The ball 2 may even be stored in a hollow portion in the handle portion 13, for example, and when provided for rolling use, the ball 2 will then be manually placed into the track, not limited in the present invention.

Or, the ball 2 may be electromagnetically attracted by an electromagnet (not shown) and then shifted to any desired track for its rolling. After putting the ball in the specific track, the electromagnet can then be switched off in order to start the rolling of the ball in the track.

The present invention provides a compact, light, space-saving exercise device for simulating hula-hoop whirling movements or rotations, being easily handled, stored and used to be superior to the conventional hula hoop.

The present invention may be modified without departing from the spirit and scope of the present invention.

I claim:

1. An exercising device for simulating hula-hoop rotations comprising:

a housing having at least a track annularly formed on a bottom of the housing, said housing fastened to a user's body portion; and at least a ball rolling in the track upon whirling of the housing and whirling of a user who wears the housing on the user's body portion; whereby upon whirling of the user's body and said housing, said ball will roll along said track in said housing for simulating a hula-hoop for exercise;

said housing further including a locking means formed on said housing for locking said ball to stop the rolling of said ball in said housing; whereby upon unlocking of said locking means, said ball will start the rolling in said housing; and an audio and visual means provided in or on said housing for audiovisually displaying or indicating the movements of said ball when rolling in said housing.

2. An exercising device according to claim 1, wherein said housing is generally circular shape and includes: a plurality of tracks concentrically formed on a bottom of the housing each said track provided for the rolling movement of the ball therein; a top cover covering the top portion of the housing; a handle portion formed on a side portion of the housing for holding or carrying purpose; and a fastening portion formed on an end portion of the handle portion adapted to be fastened on the user.

3. An exercising device according to claim 2, wherein said fastening portion is integrally formed with a fastening device attached to the user's body portion.

4. An exercising device according to claim 1, wherein said ball is made of ferrous materials to be magnetically attracted by the locking means.

5. An exercising device according to claim 4, wherein said locking means includes: a slide slidably engageable on a pair of rails formed in the housing and transversely overpassing across a track annularly formed in said housing; at least a magnet formed on said slide; and a stand-by position formed on said slide adjacent to a central portion of the housing for initially resting the ball on said stand-by position without being magnetically attracted by the magnet; whereby upon sliding movement of the magnet on the slide along the rails to approximate the ball in the track, the magnet will magnetically attract the ball to stop a rolling movement of said ball in the track; and upon returning of the magnet to the stand-by position to release magnetic attraction between the magnet and the ball, the ball will be rolled in the track upon a whirling movement for exercise by a user.

6. An exercising device according to claim 1, wherein said audio and visual means includes: a microprocessor mounted on a board secured in the housing; a plurality of selecting switches formed in the housing for selecting a plurality of operational modes to be input into the microprocessor for processing and outputting audio and visual signals; a liquid crystal display (LCD) formed on the housing for visually showing output data as processed by the microprocessor corresponding to the rolling of the ball in the housing; an audio transducer connected to the microprocessor for transducing audio signal output from the microprocessor to be audio sound or synthetic voice through a speaker connected to the transducer corresponding to the rolling of the ball in the housing; and an optical indicator including a plurality of flashing light-emitting diodes (LEDs) annularly disposed on the top cover of the housing for outputting optical flashing corresponding to the rolling of the ball in the housing; and at least a sensor provided in said track for sensing the ball when passing through the sensor to complete each turn when rolling in the track.

7. An exercising device according to claim 1, wherein said locking means includes: a screw rotatably mounted in the housing, a disk portion formed on an inner end of the screw to hold the ball to be downwardly rested in a bottom of a well recessed in a track annularly formed in said housing; whereby upon rising of the screw and the disk portion along the well until reaching a bottom level of the track, the ball will be initiated for rolling along the track upon whirling of the user and the housing worn on the user.

* * * * *